United States Patent [19]

Günther et al.

[11] Patent Number: 4,701,986

[45] Date of Patent: Oct. 27, 1987

[54] APPARATUS FOR MAKING NEEDLE FELTS FOR PAPER MACHINES

[75] Inventors: Feyerl Günther, Linz; Augustin Kalteis, Traun; Hannes Pum, Wels, all of Austria

[73] Assignee: Textilmaschinenfabrik Dr. Ernst Fehrer Aktiengesellschaft, Leonding, Austria

[21] Appl. No.: 877,029

[22] Filed: Jun. 19, 1986

[30] Foreign Application Priority Data

Jun. 21, 1985 [AT] Austria ..... 1848/85

[51] Int. Cl.[4] ..... D04H 18/00

[52] U.S. Cl. ..... 28/142; 28/110; 28/114

[58] Field of Search ..... 28/110, 114, 142

[56] References Cited

U.S. PATENT DOCUMENTS 4,536,927 8/1985 Feyerl et al. ..... 28/110
4,614,969 9/1986 Gerundt et al. ..... 28/110 X
4,621,662 11/1986 Olry ..... 28/110 X

FOREIGN PATENT DOCUMENTS 375101 11/1983 Austria .
2324985 1/1974 Fed. Rep. of Germany ..... 28/110

*Primary Examiner*—Robert R. Mackey
*Attorney, Agent, or Firm*—Kurt Kelman

[57] ABSTRACT

In apparatus for applying a sliver at a bias to an endless backing web in the making of a paper machine felt, a needle machine is preceded by a sliver feeder, which is operable by a traversing drive to perform a traversing movement across the working width of the needle machine. Irregularities can be avoided because an automatically controlled position-correcting mechanism is provided, which serves to compensate any deviation of the actual course of one longitudinal edge of the backing web from a predetermined, desired course of said longitudinal edge, and means are provided for controlling the traversing drive so that the traversing movement of the sliver feeder will be influenced by changes of the width and/or length of the backing web.

6 Claims, 3 Drawing Figures

APPARATUS FOR MAKING NEEDLE FELTS FOR PAPER MACHINES

BACKGROUND OF THE INVENTION

1. Field of the Invention

This invention relates to apparatus for making needle felts for paper machines from a sliver which is applied at a bias angle to an endless backing web that is trained around deflecting rollers, which apparatus comprises a needle machine and a sliver feeder which is displaceable by a traversing drive across the working width of the needle machine.

2. Description of the Prior Art

From Austrian Patent Specification No. 375,101 it is known that endless needle felts for paper machines can be made in that a sliver is fed in a longitudinal direction by means of a sliver feeder to an endless backing consisting of a woven fabric and said feeder is reciprocated across the width of the backing so that juxtaposed sliver loops can be applied to the backing at a predetermined bias angle in two or more layers. Because the fibers of adjacent layers cross each other, any unbalance caused by one layer with respect to the direction of travel will be compensated so that a paper machine felt made in that process will have excellent running properties and strength values, particularly because the loops formed by the sliver are needled to the woven fabric backing by means of a needle machine having a working width which equals the width of the paper machine felt to be made. But the needling of the sliver loops to the backing woven fabric must be expected to result in a change of the width and length of the web which has been formed from the woven fabric backing and the sliver loops which have been needled to said backing so that the bias angle of the previously applied sliver loops will change relative to the bias angle of the loops to be applied and can no longer be applied by the sliver feeder to the previously and sliver loops in such a manner that adjacent edges of said loops will closely adjoin each other. The resulting deviation of adjacent longitudinal edges of juxtaposed sliver loops from a parallel course will obviously result in undesirable irregularities in the structure of the paper machine felt.

SUMMARY OF THE INVENTION

It is an object of the invention to avoid the disadvantage indicated above and so to improve an apparatus which is of the kind described first hereinbefore that the sliver loops will be applied to the backing web with parallel edges in spite of the changes in width and length which will necessarily result from the needling operation.

That object is accomplished in accordance with the invention in that an automatically controlled position-correcting mechanism is provided for compensating any deviation of the actual course of a longitudinal edge of the backing web from a predetermined, desired course and speed control means are provided by which the speed of the traversing drive for traversing the sliver feeder is controlled in response to changes of the width and/or length of the backing web.

A contraction of the backing web in response to the needling operation will result in a change of the bias angle of the previously applied sliver loops so that the sliver cannot be applied to the backing in such a manner that adjacent edges of adjacent sliver loops will be parallel and will adjoin each other unless the traversing drive is controlled in such a sense that the traversing speed is so decreased that the sliver is applied to the backing web at a bias angle which agrees with the bias angle of the sliver loop that has been applied last. It will be understood that the speed control means may be used to control the application of the sliver to the backing web in such a manner that irregularities will be avoided which would otherwise result from changes of the width and/or length of the backing web. But this can only be accomplished if deviations of the actual course of a longitudinal edge of the backing web from a predetermined, desired course can be compensated by an automatically controlled position-correcting mechanism so that a predermined line of reference will be obtained for the displacement of the sliver feeder relative to the backing web across the working width of the needle machine.

A particularly simple design will be obtained if the position-correcting mechanism for restoring said one longitudinal edge of the backing web to a desired course acts to impart a pivotal movement of a pivoted deflecting roller which is wrapped by the backing web and said position-correcting mechanism is actuated in response to an output signal of a position detector which detects the course of that longitudinal edge of the backing edge which is to be readjusted. If the position detector that is responsive to the course of the longitudinal edge of the backing web indicates that the actual course of said edge deviates from its desired course, the position-correcting mechanism will impart to the pivoted deflecting roller wrapped by the backing web a pivotal movement in a sense to restore the actual course of the longitudinal edge of the backing web to its desired course and that pivotal movement will be continued until said longitudinal edge has be restored to its desired course. In this manner, any positional deviation can be corrected quickly and in a simple manner by the position-correcting mechanism, which is connected to a pivoted deflecting roller wrapped by the backing web and which is actuated in response to the output signal of the position detector.

The correction of the speed of the traversing drive will depend on the dependence of the change of the speed of the traversing drive on changes of the width and/or length of the backing web; that dependence should desirably be utilized for a determination of the speed-correcting action which is required at a given time. In accordance with a further feature of the invention, the means for controlling the speed of the traversing drive may comprise a computer, which is connected to measuring means for measuring the width of the backing web and/or to measuring means for measuring the length of the backing web. It must be borne in mind that the change of the bias of a sliver that has been needled to the backing web, e.g., in response to a change of the width of the backing web will depend on the resulting change of the ratio of the length to the width of the backing web. For this reason, the ratio of the required change of the speed of the traversing drive and the change of the width of the backing web can be represented in a relatively simple computer program and the required change of the speed of the traversing drive can desirably be derived from the data supplied by the measuring means and respresenting the measured width of the backing web. Similar remarks are applicable to the data provided by the means for measuring the length of the backing web. Under certain circumstances it may be possible to control the speed of the traversing drive only in dependence on changes of the width or only in dependence on the length of the backing web, provided that the influence of length changes in the first-mentioned case or of width changes in the second case is negligible.

To permit a simple measurement of the width of the backing web, the means for measuring the width of the backing web may comprise two position detectors for detecting the positions of respective longitudinal edges of the backing web. Because the spacing of the two position detectors is known, the width of the backing web can easily be computed from the output signals of said position detectors, particularly as the course of one longitudinal edge of the backing web is automatically controlled. As a result, one of said position detectors may desirably be used also to detect a deviation of the position-controlled longitudinal edge of the backing web from a desired position.

The backing web, which is trained around deflecting rollers, is usually tensioned by means of a tensioning car which carries at least one deflecting roller wrapped by the backing web. Such a tensioning car can be used for a simple detection of length changes of the backing web. This can be accomplished in that a detector for detecting the displacement of the tensioning car is provided because with the geometry of the means for guiding the backing web, any displacement of the tensioning car will represent a corresponding change of the length of the backing web.

DETAILED DESCRIPTION OF THE PREFERRED EMBODIMENT

Figure 1:
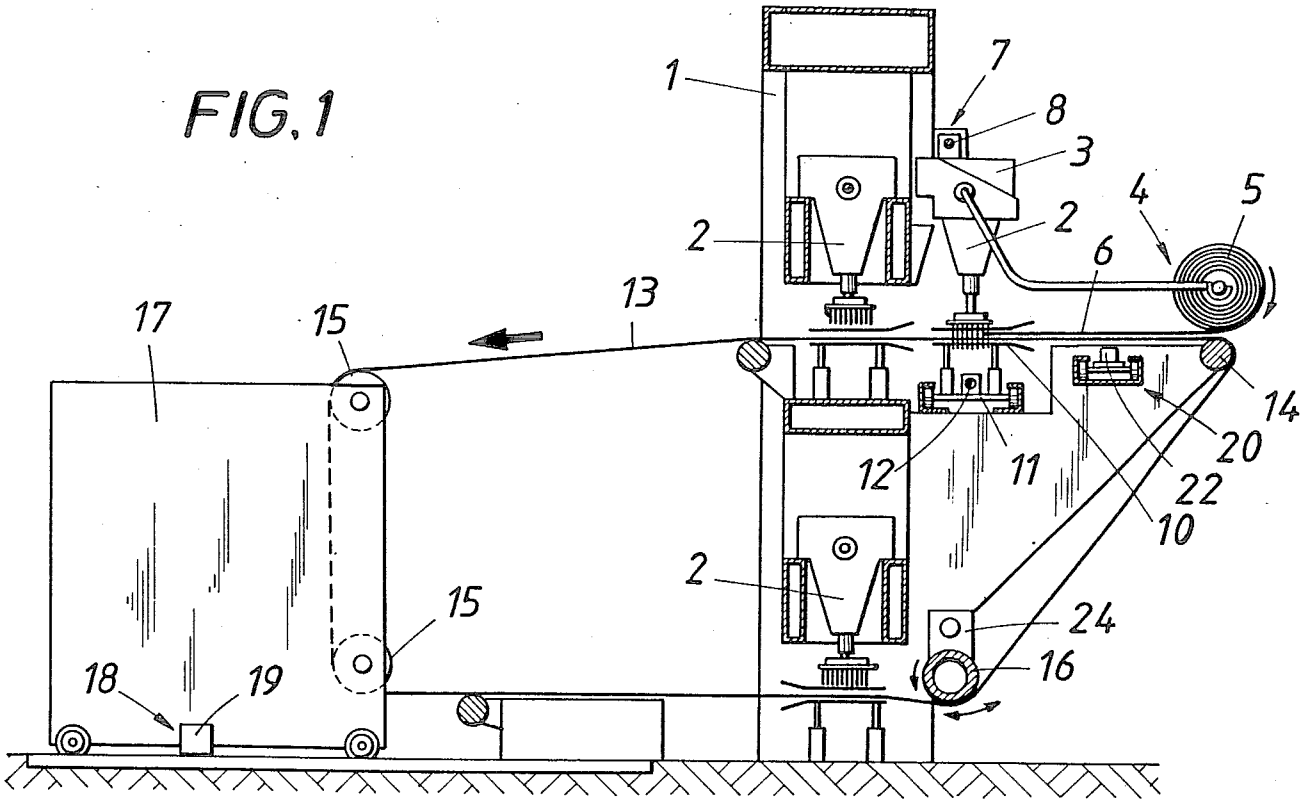
FIG. 1 is a diagrammatic side elevation showing apparatus in accordance with the invention for making endless paper machine felts.

An illustrative embodiment of the invention will now be described with reference to the drawing.

Figure 2:
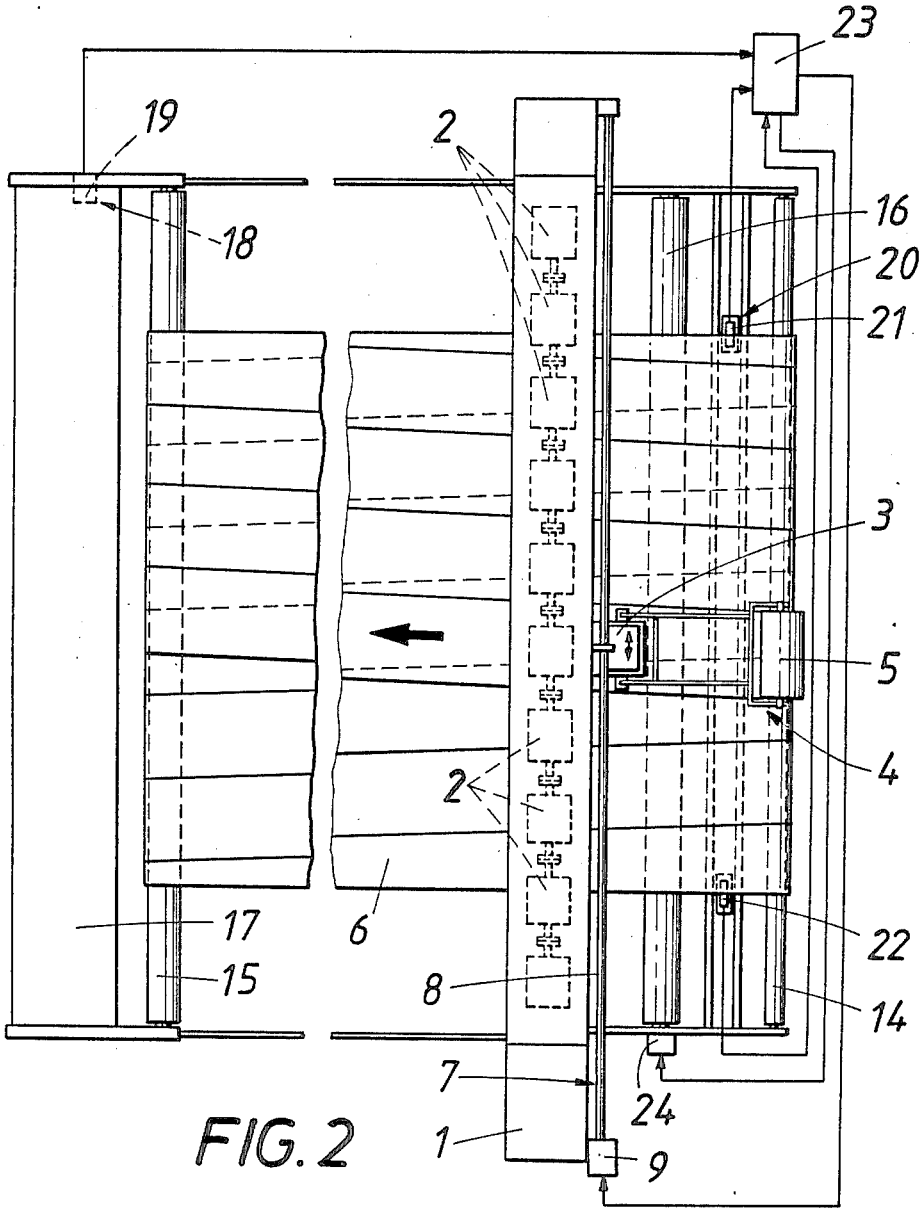
FIG. 2 is a top plan view showing the apparatus of FIG. 1 on a smaller scale.

As is apparent from FIGS. 1 and 2, the apparatus shown comprises a needle machine 1, which is a modular system comprising a plurality of needle modules 2 so that the machine has a working width that is equal to the width of the paper machine felts which are to be made. That needle machine 1 is preceded by an additional needle mechanism 3, which comprises only one needling unit 2 so that it has a smaller working width. The needle mechanism 3 succeeds a sliver feeder 4, which in the present embodiment comprises a supply roll 5, which consists of a sliver 6 and is pivoted to the needle mechanism 3. The sliver feeder 4 and the needle mechanism 3 are adapted to perform in unison a traversing movement across the working width of the needle machine 1. For this purpose the needle mechanism 3 comprises a car, which is movable on a track provided on the needle machine 1 and can be reciprocated along said track by a traversing drive 7. In the present embodiment, that traversing drive 7 comprises a feed screw 8 and a motor 9 for rotating said feed screw. Because the sliver feeder 4 is movably mounted on the needle mechanism 3, there is no need for separate means for guiding and driving the sliver feeder 4. On the other hand, the sliver feeder 4 need not be mounted on the needle mechanism 3.

Because the needle mechanism 3 is displaceable, the vertically adjustable deck 10 that is associated with the needle mechanism 3 must be displaced in unison with the latter. For this reason, the underframe of the needle mechanism 3 is also displaceably mounted on the needle machine 1 and is arranged to be driven by means of a feed screw 12 in synchronism with the top frame of the needle mechanism 3.

By means of the needle mechanism 3, the sliver 6 that has been withdrawn from the supply roll 4 can be joined to an endless backing web 13, which is trained around defecting rollers 14 and 16 and around tensioning deflecting rollers 15, which are rotatably mounted in a tensioning car 17.

As the sliver 6 is withdrawn from the supply roll 5, the latter is moved across the backing web 13 in unison with the needle mechanism 3. The latter can be operated to tack the sliver 6 to the backing web 13 at a bias angle, which will depend on the ratio of the velocity of the advancing movement of the backing web 13 to the velocity of the traversing movement imparted to the needle mechanism 3 by the traversing drive 7. As a result, a plurality of loops of the sliver 6 are applied to the backing web 13 in one layer at a certain bias and a second sliver layer, which has the same structure as the first, can be applied to said first layer so that two sliver layers are obtained which have equal and opposite bias angles.

The needling of the backing web 13 will result in changes of the width and length of the backing web. To take said changes into account, the width and the length of the backing web 13 are measured. The means 18 for measuring the length of the backing web comprise a position detector 19, which is responsive to the displacement of the tesnioning car. Because the spacing of the deflecting rollers 14 and 16 and the spacing of the tensioning rollers 15 are determined by the geometry of the apparatus and the distances from the tensioning rollers 15 to the deflecting rollers 14 and 16 will be changed by a displacement of the tensioning car 17, the output signal of the position detector 19 will represent the length of the backing web.

The means 20 for measuring the width of the backing web comprise two position detectors 21 and 22 which are associated with respective longitudinal edges of the backing web 13. As the spacing of said two position detectors 21 and 22 is fixed, the width of the backing web can be determined from the output signals of said position detectors 21 and 22.

The measuring means 18 and 20 are used for a control of the traversing drive 7 for traversing the needle apparatus 3 and the sliver feeder 4 in response to changes of the length and/or width of the backing web 13. For this purpose, a central control system 23 is provided, which is connected to the measuring means 18 and 20 and comprises a computer, which in accordance with a program will process the input data so as to determine the velocity of the traversing movement to be imparted to the needle mechanism by the traversing drive 7 if the bias of a sliver 6 that is to be applied is to be equal to the bias of the previously applied sliver loops, the bias of which has been changed in response to a change of the length and/or width of the backing web. In such an arrangement, the detection of a change of the length and/or width of the backing web 13 will have the result that the central control system 23 effects a proper control of the motor 9 so that such changes cannot adversely affect the parallel arrangement of adjacent edges of the last sliver loop that has been applied and the sliver which is applied to form the next loops.

For the control of the traversing drive 7, the backing web 13 must be maintained in a predetermined lateral position. For this purpose, an automatically controlled position-correcting mechanism 24 is provided for compensating any deviation of one longitudinal edge of the backing web 13 from a predetermined, desired course. The actual course of said longitudinal edge of the backing web 13 is detected by the position detector 21, which is associated with said longitudinal edge. In the central control system 23, the output signal of the position indicator 21 is compared with data representing a predetermined, desired course of said one longitudinal edge of the becking web and in case of a difference between the actual and desired courses, the central control system 23 causes the position-correcting mechanism 24 to operate in a sense tending to reduce that difference.

Figure 3:
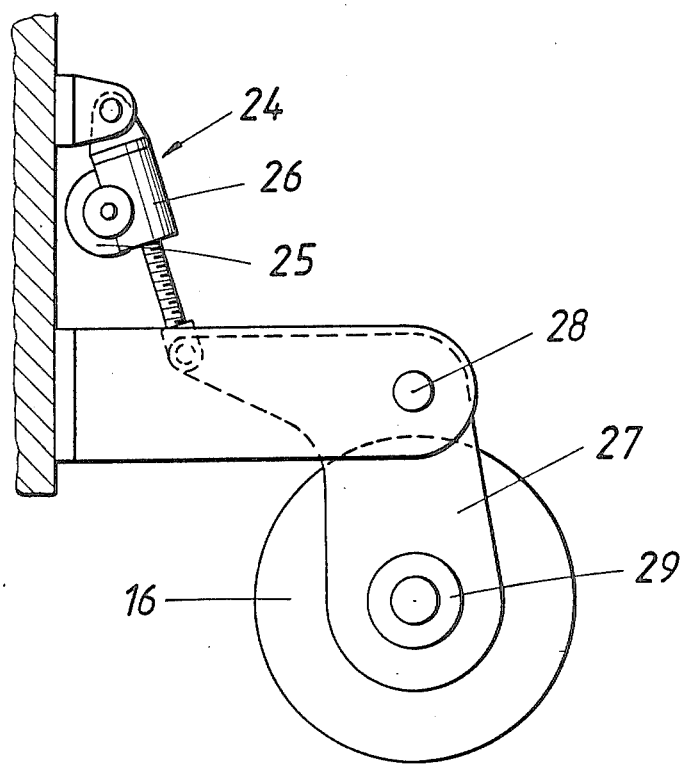
FIG. 3 is a side elevation showing on a larger scale the position correcting mechanism for adjusting a pivoted deflecting roller wrapped by the backing web.

In accordance with FIG. 3, the positioncorrecting mechanism 24 for restoring said one longitudinal edge of the backing web 13 to a desired course comprises a gearmotor 25, which via a screw mechanism 26 imparts a pivotal movement to a bellcrank lever 27. That lever 27 is pivoted on a pivot 28, which has an axis that is parallel to the axis of the deflecting roller 16 wrapped by the backing web 13. One bearing 29 for said deflecting roller 16 is carried by the bellcrank lever 27. Owing to that arrangement the position-correcting mechanism 24 is operable to impart by means of the bellcrank lever 27 a pivotal movement to the deflecting roller 16, which is mounted at its opposite end in a stationary bearing. By such pivotal movement of the deflecting roller 16, the backing web 13 will be displaced in its plane transversely to its longitudinal direction so that said one longitudinal edge of the backing web will be resotred to its desired course and a defined line of reference for the displacement of the sliver feeder 4 and of the needle mechanism 3 relative to the backing web can be established. Such a line of reference is required for a proper control of the traversing movement imparted by the traversing drive 7 in dependence on changes of the width and/or length of the backing web.

We claim:

1. In apparatus for making a needle felt for paper machines, comprising a needle machine having a working width and comprising a plurality of deflecting rollers adapted to support an endless backing web trained around said deflecting rollers so as to define in said backing web an upwardly facing web portion, said deflecting rollers being operable to impart to said backing web an advancing movement in the longitudinal direction of said web, a sliver feeder, which is adapted to perform a traversing movement across said working width, said sliver feeder being operable to deliver and apply a sliver to said upwardly facing web portion, a needling mechanism of a smaller working width than that of the needle machine between said sliver feeder and said needle machine, and a traversing drive for imparting to said sliver feeder and needling mechanism a traversing movement across said working width so that said sliver will be applied to said upwardly facing web portion to extend thereon at a bias angle to said longitudinal direction, which bias angle depends on the ratio of the velocites of said advancing and traversing movements, the improvement residing in that said needle machine comprises a position-correcting mechanism for maintaining one longitudinal edge of said backing web in a predetermined position at at least one point of said upwardly facing web portion, dimension-detecting means are provided for generating output signals representing changes of at least one of the dimensions consisting of the length of said backing web and of its width in said upwardly facing web portion, and speed control means are provided for controlling the speed of said traversing drive in dependence of said output signals.

2. The improvement set forth in claim 1, wherein one of said deflecting rollers is pivotally mounted at one end thereof on an axis which is at right angles to said longitudinal direction and displaceable in a plane at right angles to the direction of said working width, a position detector is provided for generating position signals representing the actual position of said one longitudinal edge at one point of said upwardly facing web portion relative to said predetermined position, and said position-correcting mechanism is arranged to receive said position signals and is operatively connected to said one deflecting roller and operable in response to said position signals to impart to said one deflecting roller a pivotal movement tending to move said longitudinal edge at said one point to said predetermined position.

3. The improvement set forth in claim 1, wherein said dimension-detecting means comprise a first signal generator for generating first output signals representing changes of said length of said backing web and a second signal generator for generating second output signals representing said width of said backing web and said speed control means are operable to control the speed of said traversing drive in dependence on said first and second output signals.

4. The improvment set forth in claim 3, wherein said speed control means comprise a computer for processing said first and second output signals and for controlling said speed of said traversing drive in dependence on the results of such processing.

5. The improvement set forth in claim 3, wherein said second signal generator comprises two position detectors for detecting the positions of both longitudinal edges of said backing web in said upwardly facing web portion.

6. The improvement set forth in claim 5, wherein one of said deflecting rollers is pivotally mounted at one end thereof on an axis which is tranverse to said longitudinal direction and displaceable in a plane at right angles to the direction of said working width, one of said position detectors is operable to generate position signals representing the actual position of said one longitudinal edge at one point of said upwardly facing web portion relative to said predetermined position, and said position-correcting mechanism is arranged to receive said position signals and is operatively connected to said one deflecting roller and operable to impart to said one deflecting roller a pivotal movement tending to move said one longitudinal edge at said one point to said predetermined position.

* * * * *

UNITED STATES PATENT AND TRADEMARK OFFICE

CERTIFICATE OF CORRECTION

PATENT NO. : 4,701,986

DATED : OCTOBER 27, 1987

INVENTOR(S) : FEYERL ET AL

It is certified that error appears in the above–identified patent and that said Letters Patent are hereby corrected as shown below:

Cover page, item 75 , first inventor's name should be --GUNTHER FEYERL--.

Cover page, item 19, "Gunther et al." should read -- Feyerl et al. --

Signed and Sealed this

Twenty-second Day of March, 1988

*Attest:*

DONALD J. QUIGG

*Attesting Officer*

*Commissioner of Patents and Trademarks*